US008852007B1

(12) United States Patent
Stone

(10) Patent No.: US 8,852,007 B1
(45) Date of Patent: Oct. 7, 2014

(54) AQUEOS NOVELTY APPARATUS

(71) Applicant: David Stone, Sarasota, FL (US)

(72) Inventor: David Stone, Sarasota, FL (US)

( * ) Notice: Subject to any disclaimer, the term of this patent is extended or adjusted under 35 U.S.C. 154(b) by 106 days.

(21) Appl. No.: 13/756,573

(22) Filed: Feb. 1, 2013

(51) Int. Cl.
*A63H 23/08* (2006.01)
*A63H 33/42* (2006.01)

(52) U.S. Cl.
CPC ..... *A63H 33/42* (2013.01)
USPC ..... 472/67; 446/153

(58) Field of Classification Search
CPC ..... A63H 23/10; A63H 23/14; A63H 23/16; A63H 23/08; A63G 31/00
USPC ..... 472/67, 128; 446/153, 156, 159; 40/406–409, 412, 439, 422
See application file for complete search history.

(56) References Cited

U.S. PATENT DOCUMENTS 5,146,701 A * 9/1992 Lee ..... 40/406
6,161,317 A * 12/2000 Wang ..... 40/406
6,349,492 B1 * 2/2002 Lee ..... 40/426
6,415,535 B1 * 7/2002 White et al. ..... 40/410
2006/0175277 A1 * 8/2006 Ho ..... 215/6

* cited by examiner

*Primary Examiner* — Kien Nguyen

(74) *Attorney, Agent, or Firm* — Gulf Coast Intellectual Property Group

(57) ABSTRACT

An aqueous novelty apparatus operable to provide a visual effect of a forward motion using a first liquid and a second liquid that are immiscible. The apparatus further includes a support frame having a base and a first vertical support and a second vertical support. The support frame is operable to suspend a vessel in an angular orientation. The vessel has an interior volume that is substantially hollow having the first liquid and second liquid disposed therein. A pumping system is operably coupled to the vessel and in fluid communication with the first liquid and in conjunction with the angular orientation of the vessel promotes the flow of the first liquid from one end of the vessel to a second end. A flow path disruption member shaped as a boat is disposed within the vessel and engages the flow path and results in the appearance of forward motion.

13 Claims, 1 Drawing Sheet

AQUEOS NOVELTY APPARATUS

FIELD OF THE INVENTION

The present invention relates generally to novelty devices, more specifically but not by way of limitation, an aqueous novelty device that utilizes two liquids of different densities to create a visual effect of forward motion of a boat.

BACKGROUND

The consumer retail market is quite expansive and contained therein are numerous segments of products. From clothes, sporting goods and many others, these segments create a multi-billion dollar market. One consumer market within the retail space is entertainment/novelty devices. Whether a product is designed for a special occasion such as various holidays or a product that is focused on a particular niche, the products in these markets are designed to provide an entertainment value for those engaged therewith. By example but not by way of limitation, these devices can include motion activated Christmas decorations or non-seasonal items such as party decorations. One category of entertainment devices are aqueous devices.

Aqueous devices have proven to be quite popular and range from products such as lamp bases to conventional snow globes. The aqueous based devices utilize the fluid properties of at least one liquid to create a visual entertaining effect. Existing aqueous devices typically further include at least one material that can be at least temporarily suspended in the liquid for additional visual effects. Furthermore, aqueous entertainment devices are known to utilize two immiscible liquids to create visual effects. The most common types of these devices are conventional wave machines.

As is known in the art wave machines typically are movably mounted on a motorized base so as to oscillate in a back-and-forth motion. The motion of the container will agitate the two immiscible liquids contained therein and create a visual wave effect. Other devices such as lava lamps utilize air or other gases to agitate the immiscible liquids so as to create a visual effect.

Accordingly, the features and advantages of the present invention over existing aqueous display devices will become apparent to those skilled in the art upon review of the following detailed description, claims and drawings.

SUMMARY OF THE INVENTION

It is the object of the present invention to provide a visual display device that includes two immiscible liquids to create a visual effect.

A further object of the present invention is to provide a visual display device having two immiscible liquids disposed therein that further includes a pumping system in fluid communication with one of the two immiscible liquids.

Yet another object of the present invention is to provide a visual display device that provide an entertainment value through the use of two immiscible liquids that further includes a container wherein the container is mounted in an inclined orientation.

An additional object of the present invention is to provide an aqueous visual display device having two immiscible liquids wherein one of the two immiscible liquids having a greater density than the other is in fluid communication with the pumping system.

Still another object of the present invention is to provide an aqueous visual display device that further includes a flow path disruption member disposed within the fluid path of the liquid that is in fluid communication with the pumping system.

Yet a further object of the present invention is to provide an aqueous visual display device wherein the fluid operably coupled with the pumping system is pumped in a direction so as to engage the flow path disruption member so as to create a particular visual effect.

A further object of the present invention is to provide an aqueous visual display device that includes a base having a cavity that conceals the pumping system.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
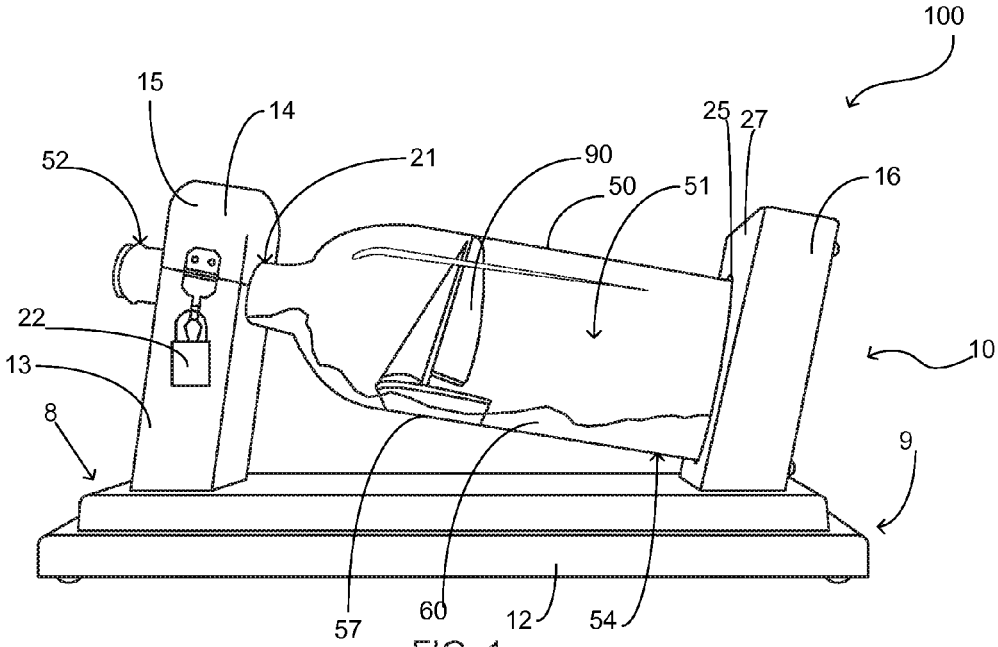
FIG. 1 is a side view of a preferred embodiment of the present invention.

Referring now to the drawings submitted herewith, wherein various elements depicted therein are not necessarily drawn to scale and wherein through the views and figures like elements are referenced with identical reference numerals, there is illustrated a aqueous novelty apparatus 100 constructed according to the principles of the present invention.

Referring in particular to FIG. 1 herein, the aqueous novelty apparatus 100 includes a support frame 10 having a base member 12, a first vertical support member 14 and a second vertical support member 16. The base member 12 is generally rectangular in shape and is manufactured from a suitable durable material such as but not limited to wood or metal. The base member 12 further includes an internal cavity 17 illustrated herein in FIG. 2. The internal cavity 17 of the base member 12 is of suitable volume to house the components of the pumping system 80. The first vertical support member 14 is mounted proximate end 8 of base member 12. The first vertical support member 14 extends upward from the base member 12 and is mounted in an angular manner having an angular bias towards end 9 of the base member 12. The first vertical support member 14 includes a lower portion 13 and an upper portion 15. The lower portion 13 and upper portion 15 are manufactured from a suitable durable material such as but not limited to wood and are hingedly connected with a conventional hinge. The lower portion 13 and upper portion 15 are shaped so as to form a generally annular shaped aperture 21 that is of suitable size to accommodate a portion of the vessel 50 therein. The hinged connection of the lower portion 13 and upper portion 15 provides a user access to the vessel 50 and facilitates removal from the support frame 10 if required. The first vertical support member 14 further includes a lock 22 having the necessary hardware functioning to inhibit removal of the vessel 50 from the support frame 10.

The second vertical support member 16 is mounted utilizing suitable durable techniques to the base member 12 proximate end 9. The second vertical support member 16 is mounted in an angular manner having a bias towards end 9. A void 25 is present on the inner surface 27 of the second vertical support member 16 that is operable to receive a portion of the vessel 50. The void 25 is generally annular in shape does not journal completely through the second vertical support member 25. It is contemplated within the scope of the present invention that the void 25 is manufactured of a shape that is operable to mateable receive a portion of the vessel 50. Those skilled in the art will recognize that the void 25 could be manufactured in numerous different shapes so as to accommodate a vessel 50 having a similar mateable shape. The first vertical support member 14 is greater in height than the second vertical support member 16. This orientation is important as the difference in height and the angular orientation of the first vertical support member 14 and the second vertical support member 16 positions the vessel 50 in an inclined manner which assists in providing desired functionality as further discussed herein. While a support frame 10 has been illustrated and discussed herein, it is further contemplated within the scope of the present invention that support frame 10 could be manufactured in alternative embodiments and still achieve the desired functionality as described herein.

The vessel 50 is suspendedly mounted intermediate the first vertical support member 14 and the second vertical support member 16. The vessel 50 is manufactured from a transparent material such as but not limited to glass or plastic. The vessel 50 is bottle shaped having an interior volume 51 of suitable size to retain fluids and at least one flow path disruption member 90. While the vessel 50 in its preferred embodiment is bottle shaped, it is contemplated within the scope of the present invention that the vessel 50 could be manufactured in numerous different shapes. The vessel 50 includes a first end 52 and a second end 54 and is mounted in an angular orientation wherein the second end 54 is lower than the first end 52. The angular orientation of the vessel 50 facilitates the desired flow path for the first liquid 60 disposed within the vessel 50. Further, the angular orientation of the vessel 50 allows the first liquid 60 to maintain fluid communication with the pumping system 80. It is contemplated within the scope of the present invention the vessel 50 could be mounted in an angular manner across a range of degrees such as but not limited to five degrees to forty-five degrees.

Disposed within the vessel 50 are a first liquid 60 and a second liquid 62. The first liquid 60 and second liquid 62 are immiscible with the first liquid 60 having a greater density than the second liquid 62. While numerous types of liquids could be utilized, it is preferred within the present invention that the first liquid 60 is a mixture of water and alcohol and the second liquid 62 is mineral spirits. It is further contemplated within the scope of the present invention that the first liquid 60 is dyed a different color than the second liquid 62. The greater density of the first liquid 60 maintains the position of the first liquid 60 proximate the bottom edge 57 of the vessel 50. As previously described herein, the angular orientation of the vessel 50 facilitates the desired flow path and location of the first liquid 60. The first liquid 60 is in fluid communication with the pumping system 80. The pumping system 80 moves the first liquid 60 from the second end 54 of the vessel 50 to the first end 52 of the vessel 50. As the first liquid 60 is pumped to the first end 52 of the vessel 50 and enters the interior volume thereof, the angular orientation of the vessel 50 promotes the flow path of the first liquid 60 such that first liquid 60 flows towards the second end 54 and flows within the vessel 50 proximate the bottom edge 57. Further, the angular orientation of the vessel 50 allows the first liquid 60 to collect within the interior volume of the vessel 50 proximate the second end 54 forming collection pool 69 so as to maintain fluid communication with the pumping system 80.

Disposed within the vessel 50 proximate the bottom edge 57 and extending upward therefrom is the flow path disruption member 90. The flow path disruption member 90 is statically mounted within the vessel 50 proximate the bottom edge 57 utilizing suitable durable techniques. The flow path disruption member 90 is fluidly engaged with the flow path of the first liquid 60 and functions to engage the flow path of the first liquid 60 so as to create a particular visual effect. In the preferred embodiment the flow path disruption member 90 is manufactured in the shape of a boat with the bow of the boat directed towards the first end 52 of the vessel 50. As the first liquid 60 flows towards the second end 54 of the vessel 50 a portion of the first liquid 60 contacts the flow path disruption member 90. As a portion of the first liquid 60 contacts the flow path disruption member 90, the flow path of the first liquid 60 is diverted in three directions. A first direction is wherein a portion of the first liquid 60 is diverted such that the portion flows around a first side of the flow path disruption member 90. A second directional flow of the first liquid 60 is created such that a portion of the first liquid 60 flows around a second side of the flow path disruption member 90. Additionally, a third directional flow of the first liquid 60 is created such that a portion of the first liquid 60 travels in a upward direction along the front surface of the flow path disruption member 90, in the preferred embodiment the bow of the boat, and then returns into either the first directional flow or second directional flow. The combination of the aforementioned directional flows of the first liquid 60 create a visual effect providing the appearance that the flow path disruption member 90 is moving through the first liquid 60. In the preferred embodiment, the flow path disruption member 90 manufactured in the shape of a boat, the three directional flows of the first liquid 60 proximate the flow path disruption member 90 provide the appearance to simulate the look of a boat moving through water. As previously mentioned herein, the angular orientation of the vessel 50 provides the required position so as to facilitate the flow path of the first liquid as described herein. It is further contemplated within the scope of the present invention that the flow path disruption member 90 could be formed in numerous different shapes in order to provide alternative visual effects. Additionally, it is further contemplated within the scope of the present invention, that the flow path disruption member 90 could be formed so as to allow a portion of the first liquid 60 to flow superposedly thereto in order to create an effect such as but not limited to a river. In this alternative embodiment, the flow path disruption member 90 could be formed to provide a visual effect of a waterfall or other water feature and wherein the aqueous novelty apparatus 100 can be positioned in a non-angular orientation. More specifically but not by way of limitation, the flow path disruption member 90 in the aforementioned alternative embodiment functions to direct the flow of the first liquid 60 to create a visual effect and not solely diverted directions thereof.

Figure 2:
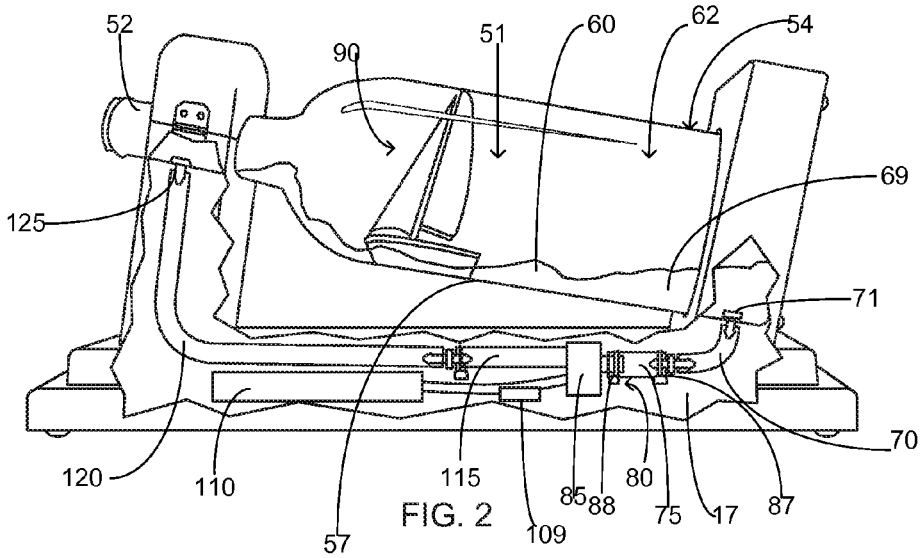
FIG. 2 is a diagrammatic view of a preferred embodiment of the present invention.

Referring in particular to FIG. 2, the pumping system 80 is illustrated therein. The pumping system 80 further includes a first hose 70 that is operably coupled to the vessel 50 using fitting 71. The first hose 70 is coupled to the vessel 50 proximate the second end 54 whereby the collection pool 69 of the first liquid 60 can maintain fluid communication therewith. The first hose 70 is manufactured from conventional hose material such as but not limited to clear PVC. The fitting 71 is a conventional barbed hose fitting that is sealably coupled with the vessel 50. It is contemplated within the scope of the present invention that numerous types of unions and/or fitting could be utilized for fitting 71. A second hose 75 is present intermediate the first hose 70 and pump 85. The second hose 75 is sealably coupled to the first hose 70 and pump 85 using clamps 87, 88. The second hose 75 is has a larger diameter than the first hose 70 and is additionally manufactured from an expandable material such as but not limited to latex tubing. The aforementioned construction of the second hose 75 accommodates the expansion of the volume of the first liquid 60 and/or the second liquid 62 due to temperature changes. The pump 85 is a conventional brushless electric pump operable to pump numerous types of fluids and is operably coupled to a power supply 110. While numerous types of power supplies could be utilized, it is contemplated within the scope of the present invention that the power supply 110 is a battery such as but not limited to an alkaline battery. Electrically intermediate the power supply 110 and the pump 85 is switch 109. The switch 109 is a conventional single pole electrical switch that controls the electrical current from the power supply 110 to the pump 85. The pump 85 is operably coupled to a third hose 115. The third hose 115 is manufactured from the same material as the second hose 75 so as to accommodate any expansion of the first liquid 60 that may be produced by the heat of the pump 85 or the environmental conditions in which the aqueous novelty apparatus 100 is subjected. A fourth hose 120 is operably coupled to the third hose 115 and is operable to connect to the vessel 50 proximate the first end 52 via fitting 125. The fourth hose 120 is manufactured from a suitable hose material such as but not limited to clear PVC tubing and is operable to deposit the first liquid 60 into the interior volume of the vessel 50 and commence the flow path thereof as discussed herein.

While not particularly illustrated herein, it is contemplated within the scope of the present invention that the vessel 50 could further include at least one light disposed therein to illuminate at least a portion thereof. It is further contemplated within the scope of the present invention that the flow path disruption member 90 could be movably mounted within the vessel 50 so as to provide alternate patterns of flow of the first liquid 60 dependent upon the position thereof within the flow path of the first liquid 60.

Referring to the Figures herein, a description of the operation of the aqueous novelty apparatus 100 is as follows. In use, a user will place the first liquid 60 and second liquid 62 within the interior volume of the vessel 50 wherein the combination of the first liquid 60 and second liquid 62 substantially fill the interior volume of the vessel 50. The vessel 50 is subsequently placed in the support frame 10, wherein the support frame 10 is operably to suspend the vessel 50 in an angular orientation. The pumping system 80 is operably coupled to the vessel 50 and is engaged so as to commence the flow of the first liquid 60. As discussed herein, the first liquid 60 maintains fluid communication with the pumping system 80 due to the density thereof. As the first liquid 60 is deposited into the interior volume of the vessel 50 proximate first end 52, the angular orientation of the vessel 50 functions to direct the flow path of the first liquid 60 toward the second end 54. As the first liquid 60 flows towards the second end 54 the flow path is disrupted by the flow path disruption member 90 as described herein. As previously discussed herein, the flow path disruption member 90 creates three directional flows creating a desired visual effect.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An aqueous novelty apparatus operable to produce a visual effect comprising:

a support frame, said support frame having a base, said base operable to be superposed a horizontal support structure, said base having a first end and a second end, said support frame further including a first vertical support member and a second vertical support member, said first vertical support member and said second vertical support member extending upward from said base and being mounted in an angular manner therewith, said first vertical support structure and said second vertical support structure being distally mounted on said base;

a vessel, said vessel being mounted intermediate said first vertical support member and said second vertical support member, said vessel being transparent and having an interior volume having a first liquid and a second liquid therein, said vessel being angular in orientation, said vessel having a first end and a second end;

a pumping system, said pumping system being disposed within said base, said pumping system further including a pump and a plurality of hose sections, said pumping system being in fluid communication with said first liquid, said pumping system having an intake end and an output end, said pumping system operable to move said first liquid from said second end of said vessel to said first end of said vessel;

a flow path disruption member, said flow path disruption member being disposed within said vessel, said flow path disruption member having a front portion, a first side and a second side, said flow path disruption member operable to engage a flow path of said first liquid as said first liquid flows from said first end to said second end, said flow path disruption member operable to direct the flow of said first liquid in a first direction, a second direction and a third direction;

wherein said flow path disruption member is operable to provide a visual effect of forward motion.

2. The aqueous novelty apparatus as recited in claim 1, wherein at least one of said plurality of hose sections of said pumping system is manufactured from an expandable material so as to accommodate any expansion of liquid volume disposed within said vessel.

3. The aqueous novelty apparatus as recited in claim 2, wherein the third direction of the flow path of said first liquid travels at least partially up the front portion of said flow path disruption member.

4. The aqueous novelty apparatus as recited in claim 3, wherein the angular orientation of said vessel facilitates the formation of a collection pool of said first liquid proximate said second end of said vessel, said collection pool operable to maintain the fluid communication of said first liquid with said intake end of said pumping system.

5. The aqueous novelty apparatus as recited in claim 4, wherein the second direction and the first direction of the flow path of said first liquid flow around opposing sides of said flow path disruption member.

6. The aqueous novelty apparatus as recited in claim 5, wherein said first vertical support member further includes an upper portion and a lower portion, said upper portion and said lower portion being hingedly secured, said upper portion and said lower portion formed to create an aperture so as to receive a portion of said first end of said vessel.

7. The aqueous novelty apparatus as recited in claim 6, wherein the flow path disruption member is shaped in the form of a boat.

8. An aqueous novelty apparatus having a bottle-shaped vessel held in an angular orientation that is operable to produce a visual effect of a forward moving boat comprising:

a support frame, said support frame having a base, said base operable to be superposed a horizontal support structure, said base being rectangular in shape having a first end and a second end, said base having an interior cavity that is substantially hollow, said support frame further including a first vertical support member and a second vertical support member, said second vertical support member having a first side and a second side, said first vertical support member and said second vertical support member extending upward from said base and being mounted in an angular manner therewith, said first vertical support structure and said second vertical support structure being distally mounted on said base, said first vertical support member having an upper portion and a lower portion hingedly attached, said upper portion and said lower portion of said first vertical support member being formed so as to have an aperture therethrough, said second vertical support member further including a void, said void being present on said first side of said second vertical support member;

a vessel, said vessel being mounted intermediate said first vertical support member and said second vertical support member, said vessel being bottle-shaped and transparent having an interior volume, said vessel further having a first liquid and a second liquid disposed therein, said first liquid and said second liquid being immiscible, said first liquid having a greater density than said second liquid, said vessel being angular in orientation, said vessel having a first end and a second end, said second end being lower than said first end, said vessel having a lower edge and an upper edge;

a pumping system, said pumping system being disposed within said base, said pumping system further including a power supply, a pump and a plurality of hose sections, said pumping system being in fluid communication with said first liquid, said pumping system having an intake end and an output end, said pumping system operable to move said first liquid from said second end of said vessel to said first end of said vessel;

a flow path disruption member, said flow path disruption member being disposed within said vessel proximate said lower edge, said flow path disruption member having a front portion, a first side and a second side, said flow path disruption member operable to engage a flow path of said first liquid as said first liquid flows from said first end to said second end, said flow path disruption member operable to direct the flow of said first liquid in a first direction, a second direction and a third direction;

wherein the angular orientation of said vessel maintains the position of said first liquid proximate said lower edge of said vessel as said first liquid flows from said first end of said vessel to said second end of said vessel subsequent said pumping system depositing said first liquid within the interior volume of said vessel proximate said first end.

9. The aqueous novelty apparatus as recited in claim 8, wherein the angular orientation of said vessel facilitates the formation of a collection pool of said first liquid proximate said second end of said vessel, said collection pool operable to maintain the fluid communication of said first liquid with said intake end of said pumping system.

10. The aqueous novelty apparatus as recited in claim 9, wherein the third direction of the flow path of said first liquid travels at least partially up the front portion of said flow path disruption member.

11. The aqueous novelty apparatus as recited in claim 10, wherein the first direction of the flow path of said first liquid flows adjacent to said first side of said flow path disruption member.

12. The aqueous novelty apparatus as recited in claim 11, wherein at least one of said plurality of hose sections of said pumping system is manufactured from an expandable material so as to accommodate any expansion of liquid volume disposed within said vessel.

13. The aqueous novelty apparatus as recited in claim 11, wherein the second direction of the flow path of said first liquid flows adjacent to said second side of said flow path disruption member.

* * * * *